US005581884A

United States Patent [19]

Iacono et al.

[11] Patent Number: 5,581,884

[45] Date of Patent: Dec. 10, 1996

[54] METHOD OF ATTACHING AN ORNAMENTAL SETTING TO AN ORNAMENT

[75] Inventors: Steven J. Iacono; Robert S. Catanzaro, both of East Greenwich, R.I.

[73] Assignee: Ultralite Technology Incorporated, Attleboro, Mass.

[21] Appl. No.: 403,473

[22] Filed: Mar. 14, 1995

[51] Int. Cl.[6] ..... B21D 39/00; B21F 43/00

[52] U.S. Cl. ..... 29/896.41; 29/522.1; 63/12

[58] Field of Search ..... 29/896.41, 522.1; 63/2, 12

[56] References Cited

U.S. PATENT DOCUMENTS

| | | | |
|---|---|---|---|
| 1,705,992 | 3/1929 | Mountford . | |
| 2,109,376 | 2/1938 | Reilly . | |
| 2,140,396 | 12/1938 | Whitaker | 29/522.1 |
| 2,290,177 | 7/1942 | Grant, Jr. | 29/522.1 |
| 3,003,378 | 10/1961 | Hotchner | 29/522.1 |
| 3,583,178 | 6/1971 | Lenard . | |
| 3,848,311 | 11/1974 | Fariello . | |
| 4,292,818 | 10/1981 | Vitau . | |
| 4,517,817 | 5/1985 | Levin . | |
| 4,761,972 | 8/1988 | Falcone . | |
| 5,184,481 | 2/1993 | Joseph et al. . | |

*Primary Examiner*—P. W. Echols
*Attorney, Agent, or Firm*—Salter & Michaelson

[57] ABSTRACT

A method of attaching an ornamental setting to a hollow ornament includes the steps of forming aligned openings in opposed walls of the ornament, inserting the post through the aligned openings in such a manner that the free end portion of the post extends outwardly beyond the wall of the ornament, substantially removing the free end portion of the post so as to leave a very small exposed portion which marginally extends beyond the outer wall of the ornament, and securing the small exposed portion of the post to the wall of the ornament. The step of securing the small exposed portion of the post to the wall of the ornament includes the step of peening the small exposed portion in such a manner that the wall has a substantially continuous outer surface at the point of attachment of the post of the ornamental setting thereto.

4 Claims, 1 Drawing Sheet

METHOD OF ATTACHING AN ORNAMENTAL SETTING TO AN ORNAMENT

BACKGROUND AND SUMMARY OF THE INVENTION

This invention relates generally to methods of attaching metal articles to one another, and more particularly to a method of attaching an ornamental setting to an ornament.

In the gold jewelry industry, articles of gold jewelry are frequently made from a gold electroform process used in connection with hollow articles. This is because articles made from solid gold are too expensive for most consumers. In many instances, in order to enhance the aesthetics of the article of jewelry, it is desirable to attach a cast ornamental setting made of gold to the gold electroform article. This setting is typically smaller than the article and may be plated with suitable material to give it a contrasting color.

A conventional method of attaching the gold ornamental setting to the gold electroform article (e.g., an earring) of hollow construction is by soldering the setting to the article. This method suffers from the disadvantage that the setting is subject to breaking away from the article, especially when the surface area(s) at the point(s) of attachment of the setting to the article is (are) relatively small. Thus, articles having settings attached thereto by soldering have high rejection rates thereby increasing the manufacturing costs associated with producing the articles. Another disadvantage associated with this method is that the heat used to solder the setting to the article has a tendency to anneal the thin walls of the hollow article which are subjected to the heat around the area of attachment thereby causing the walls to be brittle.

Another method of attachment is by using cement or glue. This method suffers from the same basic disadvantage as soldering in that it does not provide a positive secure attachment of the setting to the article. Thus, articles made by attaching settings to the articles with cement are subject to high rejection rates caused by the settings breaking away from the articles.

The instant invention provides an improved method of attaching a gold ornamental setting to an article of jewelry or an ornament of hollow construction comprising: (a) forming aligned openings in a wall of the ornament, the openings having a slightly larger diameter than the diameter of a post of the setting; (b) inserting the post through the aligned openings in such a manner that the free end portion of the post extends outwardly beyond the wall of the ornament; (c) substantially removing the free end portion of the post so as to leave a very small exposed portion which slightly extends beyond the wall of the ornament; and (d) securing the small exposed portion of the post to the wall of the ornament. More particularly, the step of securing the small exposed portion of the post to the wall of the ornament comprises the step of peening the small exposed portion in such a manner that the wall has a substantially continuous and flush outer surface at the point of attachment of the post of the ornamental setting to the ornament. The ornamental setting may have another outwardly extending post which is adapted to extend through another opening formed in the wall of the opening. The other post has an end portion with a bend wherein the post engages the wall of the opening at the bend for preventing the removal of the other post from its opening.

Accordingly, among the several objects of the present invention are the provision of an improved method of attaching a cast gold ornamental setting to a gold ornament (e.g., an earring) of hollow construction which positively and securely attaches the setting in a superior manner than prior methods of attachment thereby resulting in lower rejection rates during manufacture; the provision of such an improved method which produces an ornament having a neat, attractive appearance; and the provision of such an improved method which is easy to perform.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
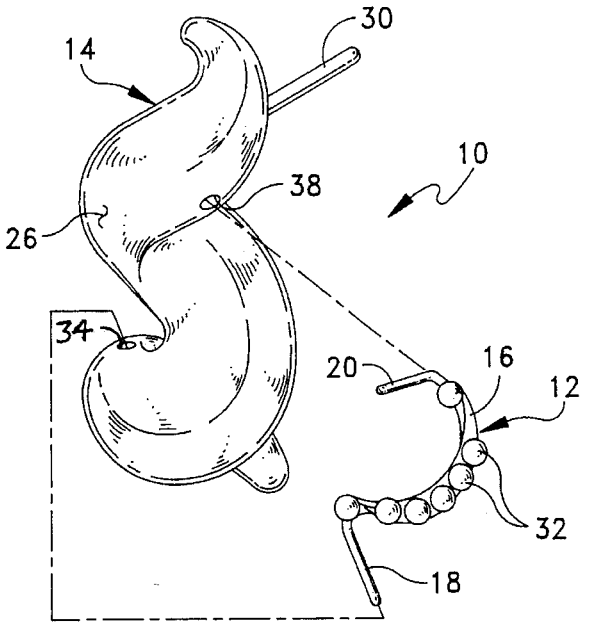
FIG. 1 is an enlarged exploded perspective view of an ornament and an ornamental setting prior to the ornamental setting's attachment to the ornament.
Figure 2:
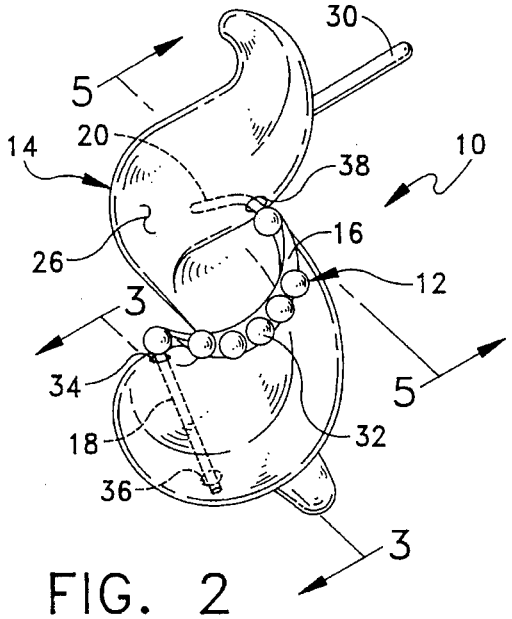
FIG. 2 is a perspective view of the ornament and ornamental setting illustrating the ornamental setting in an assembled, pre-secured relation with respect to the ornament.

Referring now to the drawings, and particularly to FIGS. 1 and 2, there is generally indicated at 10 an earring comprised of an ornamental setting, generally indicated at 12, and an ornament comprising a twist design generally indicated at 14, which are assembled pursuant to a method of the present invention. As shown throughout the several views of the drawings, the ornamental setting 12 is preferably cast from gold and includes a decorative body portion 16 and a pair of outwardly extending posts 18, 20. The body portion 16 may be plated with white gold or silver, for example, and has a plurality of decorative elements indicated at 32 set therein. The lower post 18 is of relatively straight-line construction whereas the upper post 20 has a bend formed at 22 which will be described in greater detail as the description of the method proceeds. The posts 18, 20 are masked if the body portion 16 is plated so that when they are attached to the ornament 14 they blend in with the gold color of the ornament.

The ornament 14 includes a wall 26 which defines a hollow interior region 28 and a post 30 integrally formed with the wall 26 which is adapted to be inserted into a pierced ear in a conventional fashion. A catch or clutch (not shown) may also be provided to secure the earring 10 to a wearer's ear. The ornament 14 could also be provided with a clip-on attachment instead of post 30 in the situation where a clip-on earring is desired. As shown, the ornamental setting 12 and ornament 14 are each of a "twist" design, and when assembled, the ornamental setting 12 follows along the contour of the wall 26 of the ornament 14. It should be understood that the method of the present invention for attaching the ornamental setting 12 to the ornament 14 can be applied to any number of differing and varying ornamental settings and ornaments and is not limited to the ones depicted in the drawings. The ornament 14 is preferably formed from gold electroform process which produces the hollow shape. In the jewelry industry it is important to form the ornament of hollow construction since a solid article of jewelry is too expensive for most consumers.

The method of the present invention first comprises the step of forming aligned openings 34, 36 in the wall 26 of the ornament 14 which receive the lower post 18 of the ornamental setting 12 and a single opening 38 located in a suitable location above the aligned openings 34, 36 which receives the upper post 20 of the ornamental setting 12. The aligned openings 34, 36 and upper opening 38 may be formed during the fabrication of the ornament 14 or formed by a separate step after its creation (e.g., by drilling). The openings 34, 36 and 38 have a slightly larger diameter than the diameter of the posts 18, 20 of the setting 12 so that the posts 18, 20 can freely pass axially through their respective opening(s) 34, 36 and 38 but do not excessively move from side-to-side therein.

Figure 3:
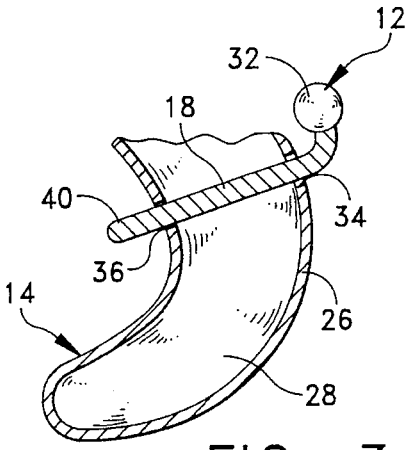
FIG. 3 is a cross-sectional view taken along line 3—3 of FIG. 2.
Figure 5:
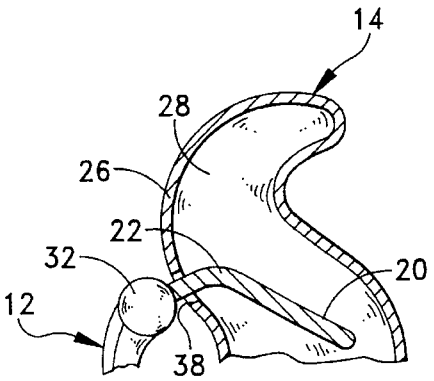
FIG. 5 is a cross-sectional view taken along line 5—5 of FIG. 2.

The next step is inserting the lower post 18 through the aligned openings 34, 36 in such a manner that the free end portion 40 of the lower post 18 extends beyond the wall 26 of the ornament 14 as illustrated in FIG. 3. After inserting the lower post 18 into openings 34, 36, the upper post 20, in the embodiment illustrated in the drawings, is inserted into the upper opening 38 in the manner illustrated in FIG. 5. It should be understood that the provision of an ornamental setting having two posts is not absolutely necessary and that one post attached pursuant to the method of the present invention is in many instances suitable for attaching the ornamental setting to the ornament. Also, the upper post 20 may be inserted into opening 38 before the lower post 18 is inserted into openings 34, 36.

Figure 4:
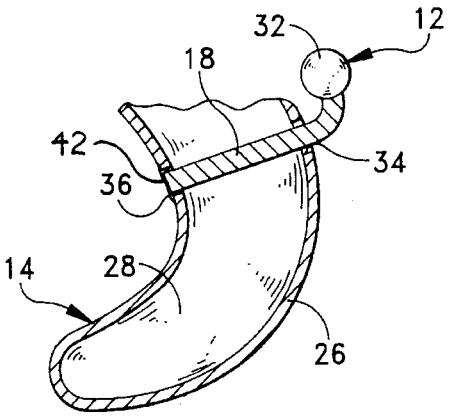
FIG. 4 is a cross-sectional view similar to FIG. 3 illustrating a post of the ornamental setting being securely attached to the ornament.

After inserting the lower and upper posts 18, 20 into their respective openings 34, 36 and 38, the end portion 40 of the lower post 18 is substantially removed (e.g., by use of wire cutters) so as to leave a very small exposed portion which slightly extends beyond the wall 26 of the ornament 14. The small exposed end portion of the post 18 is preferably secured to the wall 26 of the ornament 14 by peening (or any other suitable operation where the end of the post 18 is displaced to engage the wall 26). The portion is peened in such a manner that the wall 26 has a substantially flush continuous outer surface at the point of attachment of the post 18 of the ornamental setting 12 thereto as indicated at 42 in FIG. 4. Since the post 18 is fabricated from gold and the wall 26 of the ornament 14 is also fabricated from gold, the color of the wall at the place of attachment of the post 18 to the ornament 14 is substantially identical to the color of the rest of the wall.

It should be noted that this method of attachment provides a positive securement of the end of the post 18 to the wall 26 of the ornament 14. This is due in part to the strength of the attachment itself and also due to the fact that the post 18 goes through opening 34 which stabilizes the post and assists in preventing any movement thereof. It should also be noted that since the lower post 18 is peened for securing the ornamental setting 12 to the ornament 14, the portion of the wall 26 surrounding the opening 36 is not damaged, disfigured or substantially discolored as it would be if it were soldered, because the peened end portion of the post 18 blends into the wall 26. The ornament 14 has a neat, clean appearance at the location where the ornamental setting 12 is attached which is important for achieving a salable final product.

The bend 22 formed in the upper post 20 also assists in securing the ornamental setting 12 to the ornament 14. More specifically, the post 20 engages the wall 26 of the ornament 14 at the bend 22 for preventing the removal of the upper post 18 from the opening 38. It should be noted that the upper post 20 can alternatively be secured to the ornament 14 in the same manner as the lower post 18.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Method of attaching an ornamental setting to a gold ornament having a wall which defines a hollow interior region, said setting having at least one outwardly extending gold post, said method comprising the steps of:

(a) forming aligned openings in the wall of said ornament, said openings having a slightly larger diameter than the diameter of the post of said setting;

(b) inserting said post through the aligned openings in such a manner that the free end portion of the post extends outwardly beyond the wall of said ornament;

(c) substantially removing said free end portion of the post so as to leave a very small exposed portion which slightly extends beyond the wall of said ornament; and (d) securing the small exposed portion of the post to the wall of said ornament.

2. The method as set forth in claim 1, said step of securing the small exposed portion of the post to the wall of said ornament comprising the step of peening said small exposed portion in such a manner that the wall has a substantially flush continuous outer surface at the point of attachment of the post of the ornamental setting thereto.

3. The method as set forth in claim 1, said ornamental setting having a second outwardly extending post, said method further comprising the steps of forming another opening in the wall of the ornament and inserting said second post through said opening.

4. The method as set forth in claim 3, said second post having an end portion with a bend formed therein, said second post engaging the wall of the ornament at said bend for preventing the removal of said second post from its opening.

* * * * *